US009940499B2

(12) United States Patent
Gibson et al.

(10) Patent No.: US 9,940,499 B2
(45) **Date of Patent: *Apr. 10, 2018**

(54) PORTABLE BIOMETRIC LIGHTER

(71) Applicant: John Gibson Enterprises, Inc., San Luis Obispo, CA (US)

(72) Inventors: John Gibson, Los Osos, CA (US); Adam Olcott, Los Osos, CA (US); Mark Zand, Chatsworth, CA (US); Chan Leung, Hong Kong (CN)

(73) Assignee: John Gibson Enterprises, Inc., San Luis Obispo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/660,845

(22) Filed: Jul. 26, 2017

(65) Prior Publication Data

US 2017/0372116 A1 Dec. 28, 2017

Related U.S. Application Data

(63) Continuation of application No. 14/158,750, filed on Jan. 17, 2014, now Pat. No. 9,734,378, which is a continuation of application No. 12/195,348, filed on Aug. 20, 2008, now Pat. No. 8,653,942.

(51) Int. Cl.
*G06K 9/00* (2006.01)
*F23Q 2/16* (2006.01)

(52) U.S. Cl.
CPC ..... *G06K 9/00013* (2013.01); *F23Q 2/164* (2013.01)

(58) Field of Classification Search
CPC ..... F23Q 2/164
See application file for complete search history.

(56) References Cited

U.S. PATENT DOCUMENTS

| | | | |
|---|---|---|---|
| 2,520,328 | A | 8/1950 | Nissen |
| 2,588,479 | A | 3/1952 | Burchett |
| 3,450,143 | A | 6/1969 | Tamarin |
| 3,547,566 | A | 12/1970 | Tamarin |
| 3,744,953 | A | 7/1973 | Herr |
| 3,898,031 | A | 8/1975 | Rusakowicz |

(Continued)

FOREIGN PATENT DOCUMENTS

| | | |
|---|---|---|
| JP | 2003322340 | 11/2003 |
| JP | 2005207607 | 8/2005 |

(Continued)

OTHER PUBLICATIONS

Advisory Action for U.S. Appl. No. 12/195,348 dated Dec. 2, 2011.

(Continued)

*Primary Examiner* — Edward Park
(74) *Attorney, Agent, or Firm* — Fitch, Even, Tabin & Flannery LLP

(57) ABSTRACT

A portable biometric lighter device (100) generally involving a control unit (210), a biometric sensor, such as a fingerprint sensor (140), wherein the biometric sensor is configured to scan a biometric data of a user and is operably coupled to the control unit (210), and an ignition element, wherein the ignition element is activated by the control unit (210) upon a match of the scanned biometric data of the user and a biometric data of an authorized user that is stored in a memory device.

10 Claims, 9 Drawing Sheets

Portable Biometric Lighter
Cross-Sectional View

(56) References Cited

U.S. PATENT DOCUMENTS

| | | | |
|---|---|---|---|
| 3,978,844 | A | 9/1976 | Wilkens |
| 4,094,140 | A | 6/1978 | Ohue |
| 4,191,173 | A | 3/1980 | Dedeian |
| 4,253,818 | A | 3/1981 | Ogawa |
| 4,403,945 | A | 9/1983 | Leitgib |
| 4,512,328 | A | 4/1985 | Arad |
| 4,538,983 | A | 9/1985 | Zeller |
| 4,717,335 | A | 1/1988 | Loveless |
| 4,758,152 | A | 7/1988 | Kordecki |
| 4,784,601 | A | 11/1988 | Nitta |
| 4,784,602 | A | 11/1988 | Nitta |
| 4,786,248 | A | 11/1988 | Nitta |
| 4,799,877 | A | 1/1989 | Bisbee |
| 4,822,276 | A | 4/1989 | Bisbee |
| 4,829,981 | A | 5/1989 | Burrell |
| 4,830,603 | A | 5/1989 | Cirami |
| 4,832,596 | A | 5/1989 | Morris, Sr. |
| 4,859,172 | A | 8/1989 | Nitta |
| 4,869,663 | A | 9/1989 | Fremund |
| 4,904,180 | A | 2/1990 | Nitta |
| 4,921,420 | A | 5/1990 | Johnston |
| 4,975,978 | A | 12/1990 | Ando |
| 5,002,482 | A | 3/1991 | Fairbanks |
| 5,017,128 | A | 5/1991 | Hunter |
| 5,035,608 | A | 7/1991 | Parren |
| 5,066,220 | A | 11/1991 | Vick |
| 5,074,781 | A | 12/1991 | Fujita |
| 5,076,783 | A | 12/1991 | Fremund |
| 5,085,578 | A | 2/1992 | Hunter |
| 5,090,893 | A | 2/1992 | Floriot |
| 5,092,764 | A | 3/1992 | McDonough |
| 5,096,414 | A | 3/1992 | Zellweger |
| 5,104,313 | A | 4/1992 | Zellweger |
| 5,120,215 | A | 6/1992 | AmorosNollas |
| 5,145,358 | A | 9/1992 | Shike |
| 5,165,885 | A | 11/1992 | Iwahori |
| 5,165,886 | A | 11/1992 | Frigiere |
| 5,171,143 | A | 12/1992 | Sohn |
| 5,184,948 | A | 2/1993 | Iwahori |
| 5,186,618 | A | 2/1993 | Shike |
| 5,197,870 | A | 3/1993 | Yang |
| 5,205,729 | A | 4/1993 | Iwahori |
| 5,213,493 | A | 5/1993 | Iwahori |
| 5,213,495 | A | 5/1993 | Pan |
| D336,815 | S | 6/1993 | Cashin |
| 5,215,458 | A | 6/1993 | Cirami |
| 5,217,364 | A | 6/1993 | Frigiere |
| 5,217,365 | A | 6/1993 | Frigiere |
| 5,224,854 | A | 7/1993 | Ansquer |
| 5,228,849 | A | 7/1993 | Frigiere |
| 5,236,351 | A | 8/1993 | Tien |
| 5,240,408 | A | 8/1993 | Uematsu |
| 5,242,297 | A | 9/1993 | Cirami |
| 5,271,731 | A | 12/1993 | Hsin-Chung |
| 5,284,439 | A | 2/1994 | Shike |
| 5,288,226 | A | 2/1994 | Khemarangsan |
| 5,295,819 | A | 3/1994 | GomezLopez |
| 5,324,193 | A | 6/1994 | Pan |
| 5,332,387 | A | 7/1994 | Sheng |
| 5,334,011 | A | 8/1994 | Frigiere |
| 5,348,467 | A | 9/1994 | Piffath |
| 5,350,294 | A | 9/1994 | Iwahori |
| 5,356,286 | A | 10/1994 | Sher |
| 5,364,261 | A | 11/1994 | Huang |
| 5,387,101 | A | 2/1995 | Chan |
| 5,401,163 | A | 3/1995 | Yamazaki |
| 5,407,346 | A | 4/1995 | Sher |
| 5,409,372 | A | 4/1995 | Nobuo |
| 5,417,563 | A | 5/1995 | Cirami |
| 5,417,571 | A | 5/1995 | Kvalseth |
| 5,421,720 | A | 6/1995 | Sher |
| 5,427,522 | A | 6/1995 | McDonough |
| 5,427,523 | A | 6/1995 | Yiu |
| 5,431,558 | A | 7/1995 | McDonough |
| 5,435,719 | A | 7/1995 | McDonough |
| 5,437,549 | A | 8/1995 | Saito |
| 5,439,375 | A | 8/1995 | Wang |
| 5,445,518 | A | 8/1995 | McDonough |
| 5,451,159 | A | 9/1995 | Kim |
| 5,454,713 | A | 10/1995 | Lee |
| 5,456,598 | A | 10/1995 | McDonough |
| 5,458,482 | A | 10/1995 | Saito |
| 5,460,516 | A | 10/1995 | Sher |
| 5,460,521 | A | 10/1995 | Tsai |
| 5,462,432 | A | 10/1995 | Kim |
| 5,472,338 | A | 12/1995 | Ansquer |
| 5,483,978 | A | 1/1996 | Doiron |
| 5,487,657 | A | 1/1996 | Fairbanks |
| 5,490,773 | A | 2/1996 | LloverasCapilla |
| 5,492,468 | A | 2/1996 | Cirami |
| 5,494,436 | A | 2/1996 | Hwang |
| 5,531,591 | A | 7/1996 | Yamazaki |
| 5,538,417 | A | 7/1996 | Chan |
| 5,547,370 | A | 8/1996 | Hwang |
| 5,558,514 | A | 9/1996 | Ansquer |
| 5,584,682 | A | 12/1996 | McDonough |
| 5,584,683 | A | 12/1996 | Sher |
| 5,597,299 | A | 1/1997 | Jon |
| 5,607,295 | A | 3/1997 | Khemarangsan |
| 5,624,254 | A | 4/1997 | Kee |
| 5,628,627 | A | 5/1997 | Fairbanks |
| 5,634,787 | A | 6/1997 | Frigiere |
| 5,636,979 | A | 6/1997 | McDonough |
| 5,642,993 | A | 7/1997 | McDonough |
| 5,645,414 | A | 7/1997 | Wang |
| 5,645,415 | A | 7/1997 | Hamel |
| 5,655,901 | A | 8/1997 | Makoto |
| 5,655,902 | A | 8/1997 | Doucet |
| 5,662,466 | A | 9/1997 | Cheng |
| 5,676,537 | A | 10/1997 | Fang |
| 5,690,094 | A | 11/1997 | Sheinfeld |
| 5,697,775 | A | 12/1997 | Saito |
| 5,704,776 | A | 1/1998 | Sher |
| 5,743,725 | A | 4/1998 | Chan |
| 5,755,578 | A | 5/1998 | Contant |
| 5,759,023 | A | 6/1998 | Jenlis |
| 5,769,098 | A | 6/1998 | McDonough |
| 5,769,625 | A | 6/1998 | Sher |
| 5,788,474 | A | 8/1998 | Chung |
| 5,788,476 | A | 8/1998 | Sher |
| 5,823,765 | A | 10/1998 | LaForest |
| 5,829,963 | A | 11/1998 | Ichikawa |
| 5,833,448 | A | 11/1998 | Doucet |
| 5,836,755 | A | 11/1998 | Sheng |
| 5,839,892 | A | 11/1998 | Hwang |
| 5,846,069 | A | 12/1998 | Sher |
| 5,854,530 | A | 12/1998 | LaForest |
| 5,868,561 | A | 2/1999 | Rogelet |
| 5,882,186 | A | 3/1999 | KaiMan |
| 5,897,307 | A | 4/1999 | Chang |
| 5,897,308 | A | 4/1999 | Saito |
| 5,913,674 | A | 6/1999 | Shimizu |
| 5,915,953 | A | 6/1999 | Mifune |
| 5,931,656 | A | 8/1999 | Kanno |
| 5,934,895 | A | 8/1999 | McDonough |
| 5,947,715 | A | 9/1999 | Sheng |
| 5,957,680 | A | 9/1999 | Doucet |
| 5,967,768 | A | 10/1999 | Saito |
| 5,971,748 | A | 10/1999 | Rogelet |
| 5,971,749 | A | 10/1999 | Chen |
| 5,971,751 | A | 10/1999 | Lee |
| 5,980,239 | A | 11/1999 | Doucet |
| 5,980,242 | A | 11/1999 | Man |
| 5,997,281 | A | 12/1999 | Lei |
| 5,997,282 | A | 12/1999 | Man |
| 6,010,328 | A | 1/2000 | Sung |
| 6,012,916 | A | 1/2000 | Liang |
| 6,022,211 | A | 2/2000 | Wang |
| 6,022,212 | A | 2/2000 | Saito |
| 6,039,561 | A | 3/2000 | Lei |
| 6,039,562 | A | 3/2000 | Li |
| 6,042,367 | A | 3/2000 | Saito |
| 6,045,354 | A | 4/2000 | McDonough |
| 6,046,528 | A | 4/2000 | LaForest |

(56) References Cited

U.S. PATENT DOCUMENTS 6,050,810 A 4/2000 Huang
6,050,811 A 4/2000 Stein
6,053,727 A 4/2000 Potskhishvili
6,059,563 A 5/2000 Hsu
6,065,958 A 5/2000 Adams
6,074,198 A 6/2000 Rogelet
6,077,069 A 6/2000 Fairbanks
6,077,070 A 6/2000 Doucet
6,077,071 A 6/2000 Yeh
6,086,358 A 7/2000 Potskhishvili
6,086,359 A 7/2000 Sher
6,093,017 A 7/2000 Saito
6,095,795 A 8/2000 Potskhishvili
6,095,796 A 8/2000 Sung
6,099,296 A 8/2000 Wang
6,099,297 A 8/2000 Chan
6,099,298 A 8/2000 Potskhishvili
6,102,689 A 8/2000 Man
6,106,277 A 8/2000 Xie
6,116,892 A 9/2000 Yang
6,123,541 A 9/2000 Yang
6,126,437 A 10/2000 Lixiang
6,129,543 A 10/2000 Potskhishvili
6,129,544 A 10/2000 Chen
6,131,464 A 10/2000 Pare, Jr.
6,135,761 A 10/2000 Chen
6,135,762 A 10/2000 Hu
6,135,763 A 10/2000 Man
6,142,766 A 11/2000 Hu
6,142,767 A 11/2000 Chan
6,142,768 A 11/2000 Feng
6,146,128 A 11/2000 Feng
6,146,129 A 11/2000 Li
6,168,420 B1 1/2001 Sung
6,168,421 B1 1/2001 Hsieh
6,168,423 B1 1/2001 Man
6,171,099 B1 1/2001 Lin
6,186,772 B1 2/2001 Huang
6,186,773 B1 2/2001 Sung
6,200,130 B1 3/2001 Man
6,206,689 B1 3/2001 Doucet
6,213,759 B1 4/2001 Sung
6,217,313 B1 4/2001 Luo
6,220,853 B1 4/2001 Luo
6,224,368 B1 5/2001 Chung
6,231,335 B1 5/2001 Huang
6,234,784 B1 5/2001 Yoshinaga
6,244,858 B1 6/2001 Wang
6,264,463 B1 7/2001 Sung
6,267,582 B1 7/2001 Lin
6,273,709 B1 8/2001 Potskhishvili
6,287,109 B1 9/2001 Hirota
6,299,434 B1 10/2001 Sung
6,315,550 B1 11/2001 Sher
6,318,992 B1 11/2001 Sung
6,325,617 B1 12/2001 Sung
6,328,555 B1 12/2001 Park
6,332,771 B1 12/2001 Adams
6,332,772 B2 12/2001 Sung
6,336,807 B1 1/2002 Hsu
6,343,928 B1 2/2002 Liang
6,352,429 B1 3/2002 Sher
6,382,416 B1 5/2002 Gainey
6,386,861 B1 5/2002 Sher
6,390,809 B1 5/2002 Gerace
6,402,506 B1 6/2002 Lin
6,419,479 B1 7/2002 Huang
6,422,860 B2 7/2002 Sung
6,428,309 B1 8/2002 Doiron
6,431,853 B1 8/2002 Sher
6,431,854 B1 8/2002 Fang
6,435,859 B1 8/2002 Jon
6,439,879 B1 8/2002 Hsu
6,443,727 B1 9/2002 Huang
6,447,287 B1 9/2002 Hsu
6,454,560 B1 9/2002 Chen
6,468,070 B1 10/2002 Jon
6,478,575 B2 11/2002 Sher
6,485,291 B2 11/2002 Adams
6,488,492 B2 12/2002 Adams
6,488,493 B2 12/2002 Sung
6,491,515 B1 12/2002 Tubby
6,494,709 B1 12/2002 Li
6,506,046 B1 1/2003 Luo
6,520,768 B1 2/2003 Hsu
6,527,542 B1 3/2003 Chen
6,527,546 B1 3/2003 Laforest
6,533,575 B2 3/2003 Man
6,533,576 B1 3/2003 Sher
6,540,506 B1 4/2003 Li
6,540,507 B1 4/2003 Yang
6,551,096 B2 4/2003 Saito
6,551,097 B1 4/2003 Huang
6,565,353 B2 5/2003 Yang
6,565,354 B2 5/2003 Liang
6,575,735 B1 6/2003 LloverasCapilla
6,592,362 B2 7/2003 Fisher
6,595,770 B2 7/2003 Hsu
6,599,120 B1 7/2003 Lin
6,604,939 B1 8/2003 Li
6,612,831 B1 9/2003 Ansquer
6,612,832 B1 9/2003 Huang
6,616,443 B2 9/2003 Saito
6,638,056 B2 10/2003 Luo
6,641,389 B1 11/2003 Huang
6,641,391 B1 11/2003 Xu
6,644,958 B1 11/2003 Li
6,648,629 B2 11/2003 Ichikawa
6,648,630 B2 11/2003 Tse
6,659,763 B2 12/2003 Fisher
6,659,764 B2 12/2003 Xu
6,663,382 B2 12/2003 Li
6,663,383 B2 12/2003 Jon
6,666,677 B1 12/2003 Ichikawa
6,666,678 B2 12/2003 Sung
6,666,679 B1 12/2003 Ye
6,669,465 B2 12/2003 Yang
6,676,405 B2 1/2004 Sewalt
6,682,340 B2 1/2004 Kim
6,682,341 B2 1/2004 Pan
6,688,878 B1 2/2004 Rogelet
6,688,879 B2 2/2004 Tsai
6,692,247 B2 2/2004 Sewalt
6,695,610 B2 2/2004 Tsang
6,703,590 B1 3/2004 Holley, Jr.
6,716,024 B2 4/2004 Jon
6,722,877 B2 4/2004 Wang
6,726,469 B2 4/2004 Adams
6,733,277 B2 5/2004 Huang
6,736,630 B1 5/2004 Miyanaga
6,739,867 B2 5/2004 Puig-Gros
6,755,642 B2 6/2004 Zhang
6,764,300 B2 7/2004 Sewalt
6,765,338 B2 7/2004 Orazietti
6,786,715 B1 9/2004 Saito
6,792,287 B1 9/2004 Tuomela
6,796,791 B1 9/2004 Chung
6,808,386 B2 10/2004 Huang
6,808,387 B1 10/2004 Li
6,814,569 B2 11/2004 Sung
6,832,910 B2 12/2004 Chung
6,837,703 B2 1/2005 Saito
6,837,704 B1 1/2005 Hsu
6,840,759 B2 1/2005 Aronson, II
6,849,990 B2 2/2005 Li
6,860,733 B2 3/2005 Zhang
6,887,072 B2 5/2005 Judeng
6,893,254 B2 5/2005 Jiang
6,908,302 B2 6/2005 Sgroi, Jr.
6,918,758 B2 7/2005 Yang
6,926,518 B1 8/2005 Chung
6,939,128 B2 9/2005 Suzuki
6,939,129 B2 9/2005 Hsu
6,945,772 B2 9/2005 Chang

(56) References Cited

U.S. PATENT DOCUMENTS 6,948,927 B2 9/2005 Yang
6,951,457 B2 10/2005 Li
6,962,493 B2 11/2005 Luo
6,971,870 B2 12/2005 Sgroi, Jr.
6,979,190 B2 12/2005 Ichikawa
6,988,884 B2 1/2006 Wong
6,997,700 B2 2/2006 Kim
7,001,174 B2 2/2006 Hu
7,001,175 B2 2/2006 Yang
7,004,750 B2 2/2006 Luo
7,029,270 B2 4/2006 Wong
7,052,272 B2 5/2006 Sung
7,068,145 B2 6/2006 Reitmeier
7,102,486 B2 9/2006 Yamagishi
7,104,786 B2 9/2006 Luo
7,128,568 B2 10/2006 Yang
7,147,463 B2 12/2006 Wong
7,165,969 B2 1/2007 Yang
7,175,425 B2 2/2007 Sung
7,182,592 B2 2/2007 Perez
7,223,097 B2 5/2007 Perez
7,244,120 B2 7/2007 Jiang
7,252,504 B2 8/2007 Lin
7,300,276 B2 11/2007 Sun
7,303,389 B2 12/2007 Li
7,311,518 B2 12/2007 Sgroi
7,314,371 B2 1/2008 Hsu
7,364,427 B2 4/2008 Huang
7,369,685 B2 5/2008 DeLean
7,512,806 B2 3/2009 Lemke
7,556,494 B2 7/2009 Huang
7,581,947 B2 9/2009 Shan
7,591,645 B2 9/2009 Sewalt
7,600,996 B2 10/2009 Ruan
7,614,874 B2 11/2009 Mochizuki
7,641,471 B2 1/2010 Chung
7,682,148 B2 3/2010 Mochizuki
7,736,144 B2 6/2010 Sun
7,744,368 B2 6/2010 Frigiere
7,942,665 B2 5/2011 Kotani
RE42,750 E 9/2011 Lee
8,045,961 B2 10/2011 Ayed
8,109,760 B2 2/2012 Berkovits
8,112,066 B2 2/2012 BenAyed
8,190,129 B2 5/2012 BenAyed
8,241,033 B2 8/2012 Shimizu
8,260,262 B2 9/2012 BenAyed
8,498,618 B2 7/2013 BenAyed
8,653,942 B2 * 2/2014 Gibson ..... G06K 9/00013 340/5.52
8,747,107 B2 6/2014 Mok
8,840,398 B2 9/2014 Lee
2001/0023054 A1 9/2001 Sung
2001/0041315 A1 11/2001 Sung
2001/0044085 A1 11/2001 Sung
2002/0009684 A1 1/2002 Sung
2002/0025499 A1 2/2002 Adams
2002/0039712 A1 4/2002 Saito
2002/0055076 A1 5/2002 Adams
2002/0055077 A1 5/2002 Adams
2002/0061486 A1 5/2002 Huang
2002/0061487 A1 5/2002 Huang
2002/0061488 A1 5/2002 Sung
2002/0064744 A1 5/2002 Tse
2002/0072022 A1 6/2002 Hsu
2002/0076667 A1 6/2002 Man
2002/0086256 A1 7/2002 Sung
2002/0090586 A1 7/2002 Adams
2002/0094499 A1 7/2002 Huang
2002/0094500 A1 7/2002 Tse
2002/0106600 A1 8/2002 Sher
2002/0106601 A1 8/2002 Adams
2002/0110768 A1 8/2002 Sher
2002/0115031 A1 8/2002 Chen
2002/0115032 A1 8/2002 Tsai
2002/0119409 A1 8/2002 Amoros
2002/0119410 A1 8/2002 Sewalt
2002/0119411 A1 8/2002 Trober
2002/0132200 A1 9/2002 Hurng
2002/0132201 A1 9/2002 Zhang
2002/0136996 A1 9/2002 Ichikawa
2002/0150852 A1 10/2002 Zhang
2002/0150853 A1 10/2002 Cowl
2002/0155407 A1 10/2002 Li
2002/0160328 A1 10/2002 Tsang
2002/0160329 A1 10/2002 Zhang
2002/0177091 A1 11/2002 Chen
2002/0180313 A1 12/2002 Orazietti
2002/0182554 A1 12/2002 Fisher
2002/0192612 A1 12/2002 Pan
2002/0197576 A1 12/2002 Xu
2002/0197577 A1 12/2002 Sher
2003/0003412 A1 1/2003 ChungYang
2003/0013058 A1 1/2003 Sher
2003/0022117 A1 1/2003 Sewalt
2003/0022120 A1 1/2003 Liang
2003/0031967 A1 2/2003 Sewalt
2003/0031968 A1 2/2003 Sewalt
2003/0039934 A1 2/2003 Wang
2003/0049576 A1 3/2003 Jon
2003/0068594 A1 4/2003 Luo
2003/0096206 A1 5/2003 Saito
2003/0104329 A1 6/2003 Laforest
2003/0108836 A1 6/2003 Fisher
2003/0108837 A1 6/2003 Yang
2003/0118961 A1 6/2003 Hsu
2003/0124476 A1 7/2003 ChungYang
2003/0129554 A1 7/2003 Aronson
2003/0143504 A1 7/2003 Chung
2003/0143505 A1 7/2003 Puig-Gros
2003/0157449 A1 8/2003 Suzuki
2003/0190076 A1 10/2003 DeLean
2003/0194669 A1 10/2003 Chang
2003/0194670 A1 10/2003 Huang
2003/0203331 A1 10/2003 Hsu
2003/0207223 A1 11/2003 Li
2003/0219687 A1 11/2003 Kim
2003/0232297 A1 12/2003 Pareek
2004/0023178 A1 2/2004 Sgroi
2004/0033462 A1 2/2004 Zhang
2004/0041689 A1 3/2004 DeBono
2004/0043346 A1 3/2004 Jon
2004/0053179 A1 3/2004 Rogelet
2004/0058289 A1 3/2004 Huang
2004/0063055 A1 4/2004 Yang
2004/0081931 A1 4/2004 Sgroi
2004/0096791 A1 5/2004 Ichikawa
2004/0096792 A1 5/2004 Puig-Gros
2004/0121276 A1 6/2004 Erdmann
2004/0130244 A1 7/2004 Li
2004/0131985 A1 7/2004 Saito
2004/0137394 A1 7/2004 Sung
2004/0146823 A1 7/2004 Jiang
2004/0146824 A1 7/2004 Sewalt
2004/0155752 A1 8/2004 Radke
2004/0160335 A1 8/2004 Reitmeier
2004/0166453 A1 8/2004 Adams
2004/0191713 A1 9/2004 ChungYang
2004/0191714 A1 9/2004 Luo
2004/0191715 A1 9/2004 Nakamura
2004/0224270 A1 11/2004 Yang
2005/0014101 A1 1/2005 Hsu
2005/0037304 A1 2/2005 Serizawa
2005/0042561 A1 2/2005 Hu
2005/0042562 A1 2/2005 Lei
2005/0053880 A1 3/2005 Kim
2005/0053881 A1 3/2005 Sgroi
2005/0064355 A1 3/2005 Sung
2005/0069829 A1 3/2005 Hsu
2005/0079460 A1 4/2005 Wong
2005/0084813 A1 4/2005 Wong
2005/0100845 A1 5/2005 Yang
2005/0118546 A1 6/2005 Luo
2005/0118547 A1 6/2005 Li

(56) References Cited

U.S. PATENT DOCUMENTS

| | | | |
|---|---|---|---|
| 2005/0142510 | A1 | 6/2005 | Jiang |
| 2005/0164140 | A1 | 7/2005 | Luo |
| 2005/0170303 | A1 | 8/2005 | Huang |
| 2005/0170304 | A1 | 8/2005 | Chung |
| 2005/0175946 | A1 | 8/2005 | Lei |
| 2005/0196717 | A1 | 9/2005 | Wong |
| 2005/0202359 | A1 | 9/2005 | Lin |
| 2005/0227192 | A1 | 10/2005 | Sgroi |
| 2005/0229918 | A1 | 10/2005 | Shim |
| 2005/0239008 | A1 | 10/2005 | Sung |
| 2005/0244766 | A9 | 11/2005 | Sung |
| 2005/0257411 | A1 | 11/2005 | Wootton |
| 2005/0266366 | A1 | 12/2005 | Wu |
| 2005/0277077 | A1 | 12/2005 | Yang |
| 2005/0287488 | A1 | 12/2005 | Li |
| 2006/0024630 | A1 | 2/2006 | Williamson |
| 2006/0035185 | A1 | 2/2006 | Chan |
| 2006/0035186 | A1 | 2/2006 | Perez |
| 2006/0035187 | A1 | 2/2006 | Perez |
| 2006/0073432 | A1 | 4/2006 | Frigiere |
| 2006/0099541 | A1 | 5/2006 | Huang |
| 2006/0105282 | A1 | 5/2006 | Lang |
| 2006/0147858 | A1 | 7/2006 | Chung |
| 2006/0181521 | A1* | 8/2006 | Perreault ..... G06F 1/1613 345/173 |
| 2006/0216664 | A1 | 9/2006 | Lin |
| 2006/0223017 | A1 | 10/2006 | Sun |
| 2006/0223018 | A1 | 10/2006 | Liu |
| 2006/0269882 | A1 | 11/2006 | Wu |
| 2006/0269883 | A1 | 11/2006 | Wu |
| 2006/0281034 | A1 | 12/2006 | Ruan |
| 2006/0281035 | A1 | 12/2006 | Ruan |
| 2006/0281037 | A1 | 12/2006 | Faber |
| 2006/0286496 | A1 | 12/2006 | Tu |
| 2006/0293892 | A1 | 12/2006 | Pathuel |
| 2007/0009844 | A1 | 1/2007 | Wu |
| 2007/0020569 | A1 | 1/2007 | Hsu |
| 2007/0048681 | A1 | 3/2007 | Wong |
| 2007/0081696 | A1 | 4/2007 | Brennan |
| 2007/0107715 | A1 | 5/2007 | Grunberg |
| 2007/0172782 | A1 | 7/2007 | Weicheng |
| 2007/0224566 | A1 | 9/2007 | Ruan |
| 2007/0252898 | A1 | 11/2007 | Delean |
| 2007/0281261 | A1 | 12/2007 | Huang |
| 2007/0287112 | A1 | 12/2007 | Lai |
| 2007/0287113 | A1 | 12/2007 | Lai |
| 2007/0287114 | A1 | 12/2007 | Huang |
| 2008/0044780 | A1 | 2/2008 | Berkovits |
| 2008/0050686 | A1 | 2/2008 | Sewalt |
| 2008/0070173 | A1 | 3/2008 | Sgroi |
| 2008/0076083 | A1 | 3/2008 | Hsu |
| 2008/0090190 | A1 | 4/2008 | Sun |
| 2008/0206694 | A1 | 8/2008 | Sewalt |
| 2008/0213711 | A1 | 9/2008 | Huang |
| 2008/0213712 | A1 | 9/2008 | Huang |
| 2008/0220386 | A1 | 9/2008 | Mochizuki |
| 2008/0241773 | A1 | 10/2008 | Mochizuki |
| 2009/0004613 | A1 | 1/2009 | Shan |
| 2009/0029301 | A1 | 1/2009 | Shimizu |
| 2009/0061371 | A1 | 3/2009 | Fang |
| 2009/0087803 | A1 | 4/2009 | Tao |
| 2009/0098493 | A1 | 4/2009 | Huang |
| 2009/0104574 | A1 | 4/2009 | Ruan |
| 2009/0191496 | A1 | 7/2009 | Hsu |
| 2009/0197213 | A1 | 8/2009 | Huang |
| 2009/0246721 | A1 | 10/2009 | Wu |
| 2010/0021854 | A1 | 1/2010 | Kotani |
| 2010/0045430 | A1 | 2/2010 | Gibson |
| 2010/0047729 | A1 | 2/2010 | Yang |
| 2010/0062383 | A1 | 3/2010 | DominguezEsteban |
| 2010/0081101 | A1 | 4/2010 | Shan |
| 2010/0092899 | A1 | 4/2010 | Hsu |
| 2010/0099053 | A1 | 4/2010 | Lai |
| 2010/0190121 | A1 | 7/2010 | Mochizuki |
| 2010/0216081 | A1 | 8/2010 | Huang |
| 2010/0321151 | A1 | 12/2010 | Matsuura |
| 2010/0321152 | A1 | 12/2010 | Argudyaev |
| 2011/0091825 | A1 | 4/2011 | Huang |
| 2011/0097675 | A1 | 4/2011 | Deng |
| 2011/0137657 | A1 | 6/2011 | Cenedese |
| 2011/0215921 | A1 | 9/2011 | BenAyed |
| 2011/0293095 | A1 | 12/2011 | BenAyed |
| 2011/0313922 | A1 | 12/2011 | BenAyed |
| 2012/0019361 | A1 | 1/2012 | BenAyed |
| 2012/0019379 | A1 | 1/2012 | BenAyed |
| 2012/0183912 | A1 | 7/2012 | Mok |
| 2012/0204853 | A1 | 8/2012 | Simmons |
| 2012/0251961 | A1 | 10/2012 | Lee |
| 2012/0270163 | A1 | 10/2012 | Adams |
| 2013/0164698 | A1 | 6/2013 | Lefebvre |
| 2014/0175081 | A1 | 6/2014 | Hwa |
| 2014/0193049 | A1 | 7/2014 | Gibson |

FOREIGN PATENT DOCUMENTS

| | | |
|---|---|---|
| JP | 2006138526 | 6/2006 |
| WO | 03093729 | 11/2003 |

OTHER PUBLICATIONS

Advisory Action from U.S. Appl. No. 12/195,348 dated Jul. 31, 2012.

Applicant Initiated Interview Summary from U.S. Appl. No. 12/195,348 dated Jan. 3, 2012.

Applicant Initiated Interview Summary from U.S. Appl. No. 12/195,348 dated May 15, 2012.

Applicant Initiated Interview Summary from U.S. Appl. No. 12/195,348 dated Jun. 27, 2013.

Applicant Initiated Interview Summary from U.S. Appl. No. 12/195,348 dated Jul. 1, 2013.

Examiner Initiated Interview Summary from U.S. Appl. No. 12/195,348 dated Oct. 9, 2013.

Final Office Action for U.S. Appl. No. 12/195,348 dated Sep. 28, 2011.

Final Office Action from U.S. Appl. No. 12/195,348 dated Jun. 5, 2012.

International Search Report and Written Opinion of the International Searching Authority for PCTUS2009052014 dated Feb. 18, 2010.

Interview Summary for U.S. Appl. No. 12/195,348 dated Dec. 2, 2011.

Interview Summary for U.S. Appl. No. 12/195,348 dated May 21, 2012.

Non Final Office Action for U.S. Appl. No. 12/195,348 dated Jun. 9, 2011.

Non Final Office Action for U.S. Appl. No. 12/195,348 dated Feb. 15, 2012.

Non Final Office Action from U.S. Appl. No. 12/195,348 dated Mar. 27, 2013.

Notice of Allowance for U.S. Appl. No. 12/195,348 dated Oct. 9, 2013.

U.S. Appl. No. 14/158,750, filed Jan. 17, 2014.

U.S. Appl. No. 12/195,348, filed Aug. 20, 2008.

USPTO; Applicant Initiated Inteview Summary issued in U.S. Appl. No. 14/158,750 dated Mar. 28, 2017.

USPTO; Final Office Action issued in U.S. Appl. No. 14/158,750 dated Dec. 23, 2016.

USPTO; Non-Final Office Action issued in U.S. Appl. No. 14/158,750 dated Aug. 17, 2016.

USPTO; Notice of Allowance issued in U.S. Appl. No. 14/158,750 dated Apr. 11, 2017.

USPTO; Restriction Requirement issued in U.S. Appl. No. 14/158,750 dated May 27, 2016.

* cited by examiner

Portable Biometric Lighter
Frontal Perspective View

Portable Biometric Lighter - Partial Exploded View

Portable Biometric Lighter
Cross-Sectional View

Circuit Diagram of Portable Biometric Lighter

Alternative Circuit Diagram of Portable Biometric Lighter

PORTABLE BIOMETRIC LIGHTER

This application is a continuation of U.S. application Ser. No. 14/158,750 filed Jan. 17, 2014, for PORTABLE BIOMETRIC LIGHTER, which is a continuation of U.S. application Ser. No. 12/195,348 filed Aug. 20, 2008, for PORTABLE BIOMETRIC LIGHTER, now U.S. Pat. No. 8,653,942, both of which are incorporated in their entirety herein by reference.

TECHNICAL FIELD

The present invention generally technically relates to portable biometric lighter devices, and more specifically, to portable lighters using biometric data to prevent unauthorized usage. The present invention technically relates to devices ensuring that a user of a portable lighter is an authorized user and that a minor will not be able to activate the portable lighter.

BACKGROUND ART

Portable lighters are commonly used for lighting cigarettes, tobacco pipes, cigars, charcoal grills, pilots of gas appliances, fireplaces, water-heaters, and campfires. These portable lighters are typically activated by a user opening a cap, manually flicking a wheel to create a spark, and depressing a button that allows lighter fluid to flow. Unfortunately, these typical portable lighters have no safety mechanism to prevent an unauthorized user, such as a child, from activating a flame and accidently causing fire and bodily injuries, or other unauthorized users from intentionally causing fires. While some portable lighters have incorporated safety precaution mechanisms to deal with the possibility of misuse of a portable lighter, such examples include a portable lighter that incorporates a gas valve button that will not allow lighter fluid to flow unless a force of an adult finger is applied to the gas valve button, and a portable lighter that incorporates an electronic alphanumeric keypad to control access to the portable lighter's ignition mechanisms. These examples, however, have their shortcomings in that they are not user-friendly for the authorized user and the safety mechanisms that are in place can easily be tampered by a child.

With respect to the portable lighter that incorporates a gas valve button, requiring the force of an adult's finger, an authorized adult user may not always be able to apply the force necessary to activate the button or an older aged child may have the ability to apply a force that mimics that of an adult. With respect to the alphanumeric keypad and requiring a security code to activate the lighter, an authorized user may forget the security code or a child can gain access to the code by merely viewing the authorized user enter the security code.

Thus, a long-felt need exists in the art for a portable lighter that is able to easily recognize the authorized user of the portable lighter and that is able to prevent an unauthorized user, e.g., a child, from mimicking the authorized user. The incorporation of a biometric sensor and biometric data, such as a fingerprint sensor and a fingerprint data, satisfies the aforementioned needs.

SUMMARY OF THE INVENTION

In one embodiment, the present invention involves as a portable biometric lighter device, comprising: a control unit; a biometric sensor, wherein the biometric sensor is configured to scan a biometric data of a user and is operably coupled to the control unit; and an ignition element, wherein the ignition element is activated by the control unit upon a match of the scanned biometric data of the user and a biometric data of an authorized user that is stored in a memory device. While the present invention focuses on portable biometric lighter devices, it is not limited to portable biometric lighter devices, as it can be applied to countless other portable flammable devices and systems that require safety precautions. In addition, while the present invention comprises a fingerprint sensor as the biometric sensor and a fingerprint as the biometric data, by example only, other types of biometric sensors and other types of biometric data can be incorporated, such as a voice sensor and voice data, an age detector and an age data, or a facial image sensor and a facial image data. The present invention also involves a method of fabrication of the portable biometric device.

In another embodiment, the invention can be characterized as a method for controlling access to a portable biometric lighter device, comprising the steps of: scanning a biometric data from an authorized user; storing in a memory device the biometric data from the authorized user; scanning a biometric data from a user; determining a match between the scanned biometric data from the authorized user and the scanned biometric data from the user; and activating the portable biometric lighter device upon the match between the scanned biometric data from the authorized user and the scanned biometric data from the user.

In yet another embodiment, the invention involves a portable biometric lighter device, comprising a device for scanning a biometric data from an authorized user; a device for scanning a biometric data from a user; and a device for activating the portable biometric lighter device upon a match of the biometric data from the authorized user and the biometric data from the user.

Advantages of the present invention include, but are not limited to, providing enhanced safety to incendiary devices, decreasing the probability of accidental fire or arson, decreasing the probability of personal injury, decreasing the probability of property damage, and decreasing the cost of fire insurance. Other features of the present invention are disclosed, or are apparent, in the section entitled "Mode(s) for Carrying-Out the Invention," disclosed, infra.

BRIEF DESCRIPTION OF THE DRAWINGS

For a better understanding of the present invention, reference is made to the below-referenced accompanying Drawing(s). Reference numbers refer to the same or equivalent parts of the present invention throughout the several figures of the Drawing(s).

MODE(S) FOR CARRYING-OUT THE INVENTION

Figure 1:
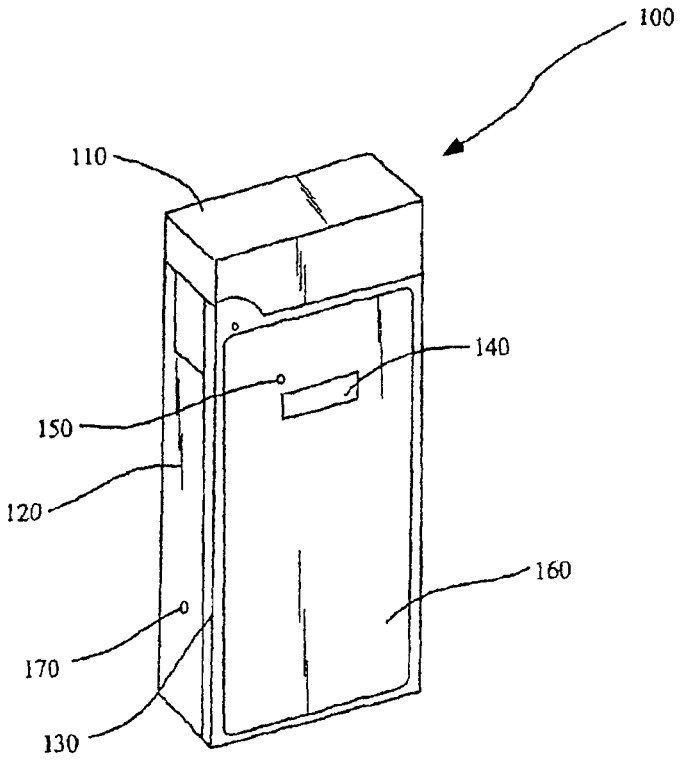
FIG. 1 is a frontal perspective view of a portable biometric lighter, showing a cap, a body, a body cover, a fingerprint sensor, a light emitting diode (LED), a label, and a set switch, in accordance with the present invention.

Referring to FIG. 1, a front perspective view of a portable biometric lighter device 100 shows a cap 110, a body 120, a body cover 130, a fingerprint sensor 140, an LED 150, a label 160, and a set switch 170. The portable biometric lighter device 100 as shown in FIG. 1 is that of a cigarette/cigar lighter type, by example only. Other examples of alternative embodiments of the portable biometric lighter device 100, not shown, can be that of a utility lighter, a barbeque lighter, and an oil-lighter. The portable biometric lighter device 100 can be that of a disposable type, e.g., wherein the user disposes of the portable biometric lighter 100 once the lighter fluid or the power source is expended, or a reusable type, e.g., wherein the user can replace the power source and/or refill the lighter fluid. The lighter fluid may comprise at least one flammable component, such a butane gas, aliphatic hydrocarbon, a kerosene, a paraffinic hydrocarbon, a napthenic hydrocarbon, a benzene, a terpene, a terpenoid, a methanol, an ethanol, a propanol, a butanol, an aliphatic naptha, a hexamine, a lacolene, and the like.

The portable biometric lighter device 100, as shown, comprises a cap 110. The cap 110 is hingedly coupled to the body 120 and is configured to prevent accidental activation of both a gas valve lever (not shown) and an active switch (not shown). The cap 110 may also be configured to activate the fingerprint sensor 140 and allow lighter fluid (not shown) to flow when it is flipped open. The cap 110 is typically made of the same material as the body 120. While FIG. 1 shows the biometric lighter 100 with a cap 110, alternative embodiments may not comprise the cap 110.

The body 120, as shown in FIG. 1, is of a rectangular shape; however, alternative embodiments of the portable biometric lighter 100 may involve other shapes, such as a square shape, a circular shape, a cylindrical or tubular shape, or an oval shape. The body 120 comprises any material, such as a polymer, a plastic, a metal, a heat-resistant material, and a composite. The body 120 is configured to house at least one of the following elements: a lighter fluid (not shown), a set switch 170, a fingerprint sensor 140, an LED 150, a control unit (not shown), a plurality of control lines (not shown), a power source (not shown), and a lighter fluid valve (not shown). The body 120 comprises an aperture for providing access to the set switch 170.

The body cover 130 comprises the same shape as that of the body 120 of the portable biometric lighter device 100, and also typically comprises the same material as that of the body 120. The body cover 130 is configured to cover the aforementioned housed elements (not shown) in the body 130. The body cover 130 comprises apertures for access to a fingerprint sensor 140 and an LED 150.

A biometric sensor, e.g., the fingerprint sensor 140, is operably coupled to a control unit (not shown). The biometric sensor is housed in the body 120 and is configured to scan and optionally store, in a memory device (not shown), an authorized user's biometric data, e.g., an authorized user's fingerprint, and a user's biometric data, e.g., a user's fingerprint, through an aperture of the body cover 130.

The LED 150 is operably coupled to the control unit (not shown). In addition, the LED 150 is configured to provide indications to a user, via blinking and/or indicating a color, such indications including the status of the portable biometric lighter functions, e.g., setup/teaching mode, low battery, failed scan, and incorrect match, by example only.

The label 160 is adhesively attached to the body cover 130. The label 160 comprises apertures for the fingerprint sensor 140 and the LED 150. The label 160 is configured to allow a manufacturer to place design features (not shown) or brand indicators (not shown), by example only. The label 160 further comprises apertures for accommodating a fingerprint sensor 140 and an LED 150.

The set switch 170 is operably connected to the control unit (not shown) and is housed in the body 120. Accessing the set switch 170 is performed through at least one aperture of the body 120. The set switch 170 is configured to activate the control unit (not shown) for accepting a new fingerprint, and to optionally erase a prior fingerprint from a memory device (not shown) if the control unit (not shown) is configured to allow erasing prior fingerprint and accepting new fingerprint.

Figure 2:
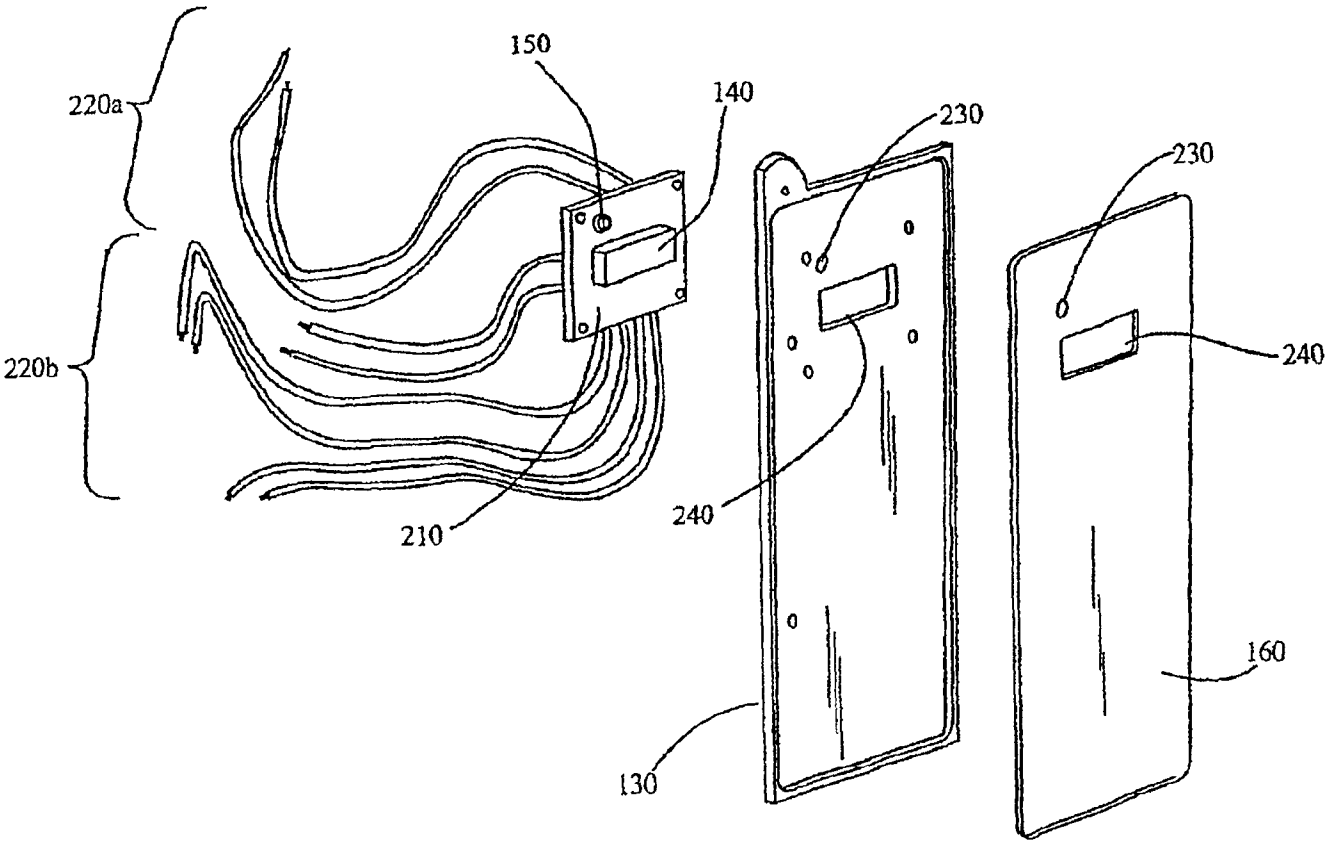
FIG. 2 is a partial exploded view of the portable biometric lighter, in accordance with the embodiment of FIG. 1, showing a label, a body cover, a fingerprint sensor, an LED, a control unit, a plurality of power lines and control lines, a plurality of LED apertures, and a plurality of fingerprint sensor apertures.

Referring to FIG. 2, a partial exploded view of the portable biometric lighter device 100 is shown, in accordance with the embodiment of FIG. 1, the device 100 comprising a label 160, a body cover 130, a biometric sensor, e.g., a fingerprint sensor 140, an LED 150, a control unit 210, a plurality of power lines 220*a* and control lines 220*b*, a plurality of LED apertures 230, and a plurality of fingerprint sensor apertures 240.

Figure 3:
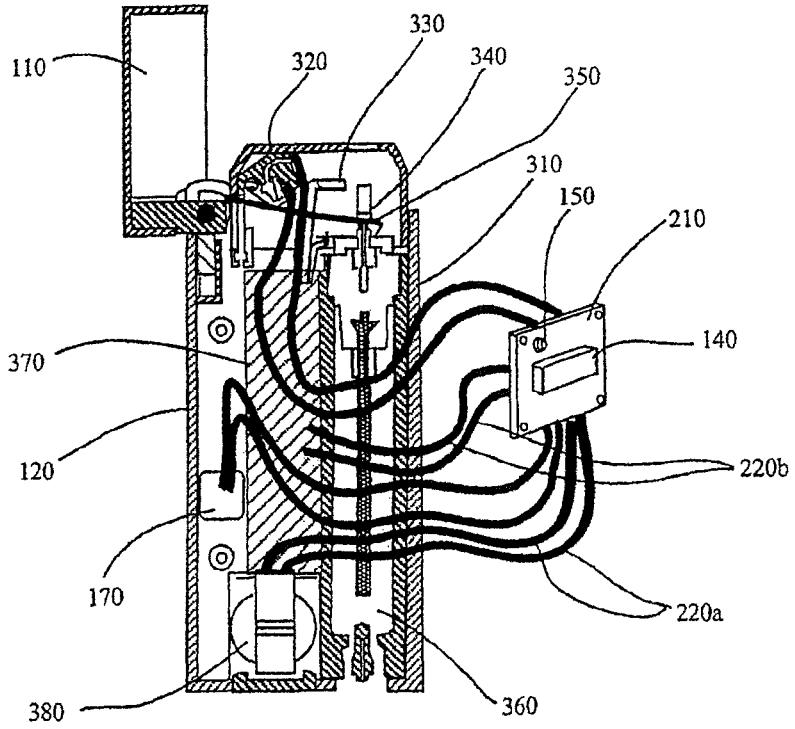
FIG. 3 is a cross-sectional view of the portable biometric lighter, in accordance with the embodiment of FIG. 1, showing a cap, a body, a fingerprint sensor, an LED, a control unit, a plurality of power lines, a plurality of control lines, a set switch, a gas lever, an active switch, a lighter fluid valve, a nozzle, a pulse igniter, a pole, a lighter fluid, and a power source.

Referring to FIG. 3, a cross-sectional view of the portable biometric lighter device 100 is illustrated, in accordance with the embodiment of FIG. 1. The device 100 comprises a cap 110, a body 120, a biometric sensor, e.g., a fingerprint sensor 140, an LED 150, a control unit 210, a plurality of power lines 220*a*, a plurality of control lines 220*b*, a set switch 170, a gas lever 350, an active switch 320, a lighter fluid valve 310, a nozzle 340, a pulse igniter 370, a pole 330, a lighter fluid 360, and a power source 380. Alternatively, an electric gas valve (not shown) may be used in place of the cap 110.

A power source 380 is operably coupled to a control unit 210 and is housed within a body 120. The power source 380 can be a primary cell battery, a rechargeable battery, or a photo-voltaic cell, by example only. The power source 380 provides power to the control unit 210 and/or the fingerprint sensor 140 via a plurality of power lines 220*a*.

The active switch 320 is operably coupled to the fingerprint sensor 140 such that upon a user flipping open the cap 110, the gas lever 350 is pulled up and activates the active switch 320 via contact force or electromagnetic force. The active switch 320 upon activation then activates the fingerprint sensor 140 to read or scan a fingerprint. The gas lever 350 is also configured to lift the nozzle 340, which allows the lighter fluid 360 to be released from the lighter fluid valve 310, upon the user flipping open the cap 110.

A pulse igniter 370, such as a piezoelectric based circuit, is configured to produce a high voltage spark from a pole 330 to the nozzle 340 upon the control unit 210 determining a match between a scanned user's biometric data, such as the user's fingerprint and the authorized user's biometric data, e.g., authorized user's fingerprint, that is previously stored in a memory device (not shown). A flame is subsequently produced when the high voltage sparks come in contact with the lighter fluid 360 that is flowing through the lighter fluid valve 310 to the nozzle 340.

Figure 4:
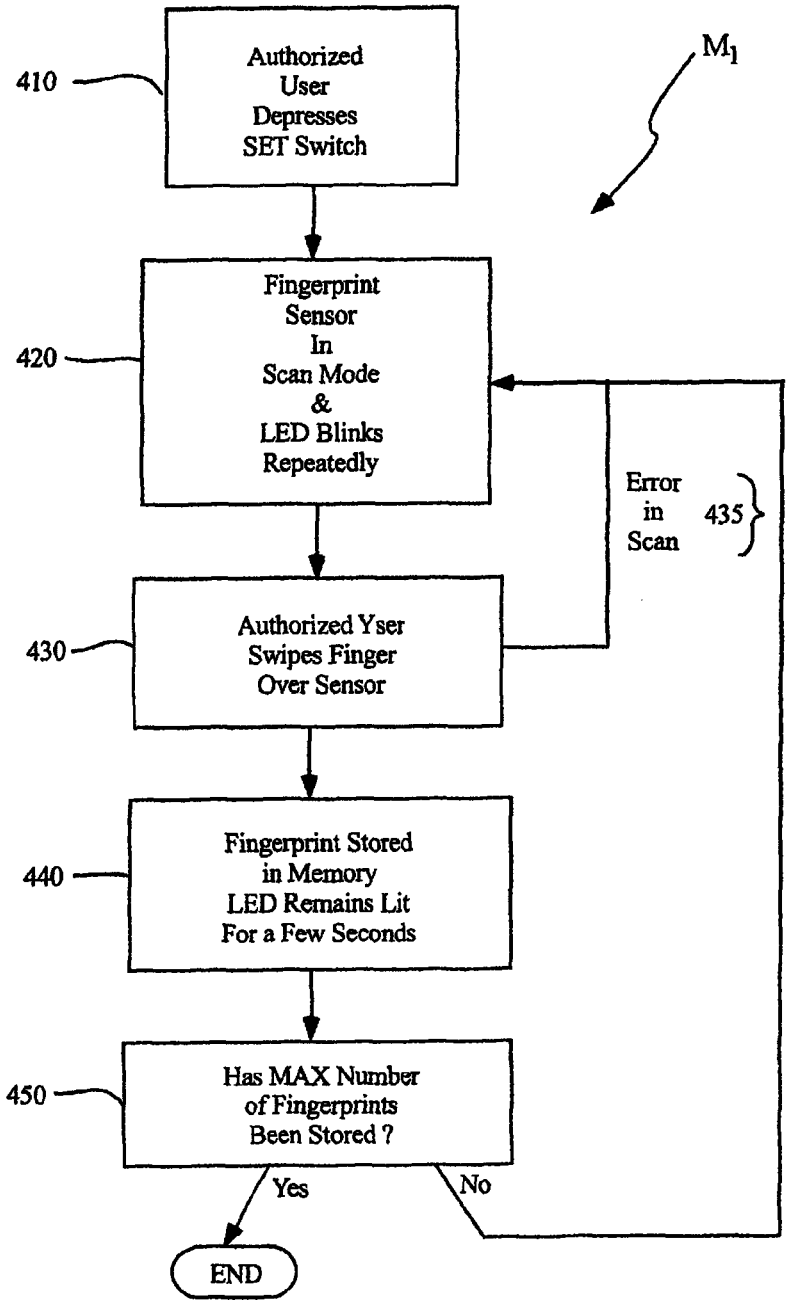
FIG. 4 is a flowchart showing the steps of a method of teaching an authorized user's fingerprint to the portable biometric lighter, in accordance with the embodiment of FIG. 1.

Referring to FIG. 4, a flowchart illustrates the steps of a method $M_1$ of setting-up/teaching an authorized user's biometric data, e.g., fingerprint, to the portable biometric lighter device 100, by way of a biometric lighter device 100, in accordance with the embodiment of FIG. 1. The first teaching step 410 comprises the step of an authorized user depressing a set switch 170. The second teaching step 420 comprises commencing periodic or repetitious blinking by an LED 150 to indicate that the fingerprint sensor 140 is ready to scan. The third teaching step 430 comprises the step of an authorized user swiping or depressing his or her finger, preferably the thumb or the index finger, over the fingerprint sensor 140. If an error in scanning the fingerprint occurs, the LED 150 continues to blink repeatedly as indicated by method step block 435. The fourth teaching step 440 comprises the fingerprint sensor 140 successfully scanning and storing fingerprint data in a memory device, wherein the LED 150 remains lit for a brief interval before extinguishing. According to block 450, this process of teaching may be repeated until a manufacturer pre-determined maximum number of fingerprints is stored, e.g., 4 fingerprints. In this embodiment, the stored fingerprints are not erasable or changeable.

Figure 5:
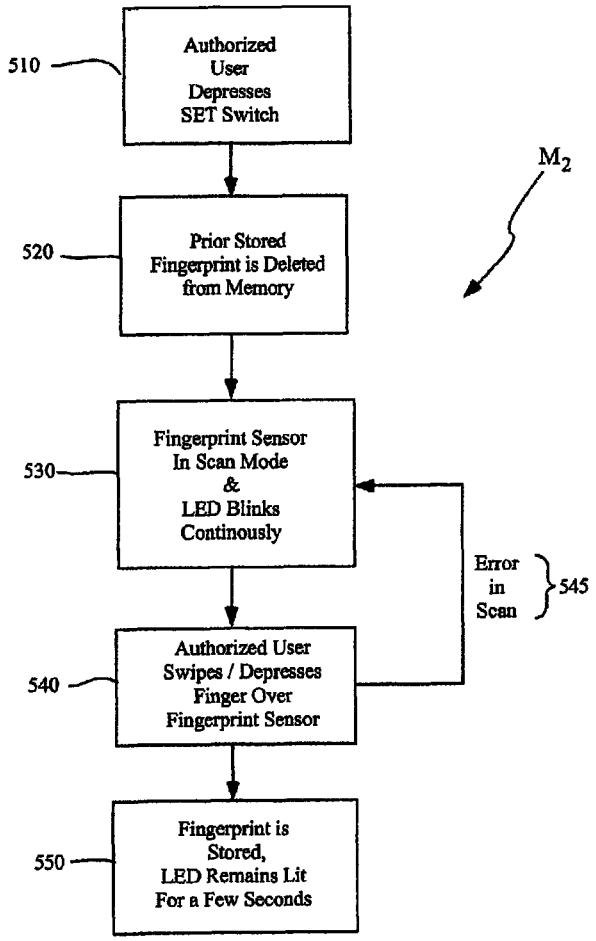
FIG. 5 is a flowchart showing the steps of an alternative method of teaching an authorized user's fingerprint to the portable biometric lighter, in accordance with the embodiment of FIG. 1, wherein a prior fingerprint that is stored in a memory device is cleared upon the teaching of a new authorized user's fingerprint.

Referring to FIG. 5, a flowchart shows the steps of an alternative method $M_2$ of teaching an authorized user's fingerprint to the portable biometric lighter device 100, in accordance with the embodiment of FIG. 1, wherein prior fingerprint that being stored in a memory device is erased upon teaching of a new authorized user's fingerprint.

The first alternative teaching step 510 in the method $M_2$ involves an authorized user depressing/activating a set switch 170. Then the second alternative teaching step 520 comprises deleting prior stored fingerprint data of an authorized user from a memory device (not shown). The third alternative teaching step 530 comprises commencing periodic or repetitious blinking by an LED 150 to indicate that the fingerprint sensor 140 is ready to scan in new authorized user's biometric data, e.g., a fingerprint. The fourth alternative teaching step 540 comprises swiping by an authorized user's finger, preferably the thumb or the index finger, over the fingerprint sensor 140. If an error occurs in scanning the fingerprint, the LED 150 continues to blink repeatedly as indicated by method step 545. The fifth alternative teaching step 550 comprises successfully scanning and storing a fingerprint scan in a memory device (not shown) by the fingerprint sensor 140, wherein the LED 150 remains lit for a brief interval before extinguishing.

Figure 6:
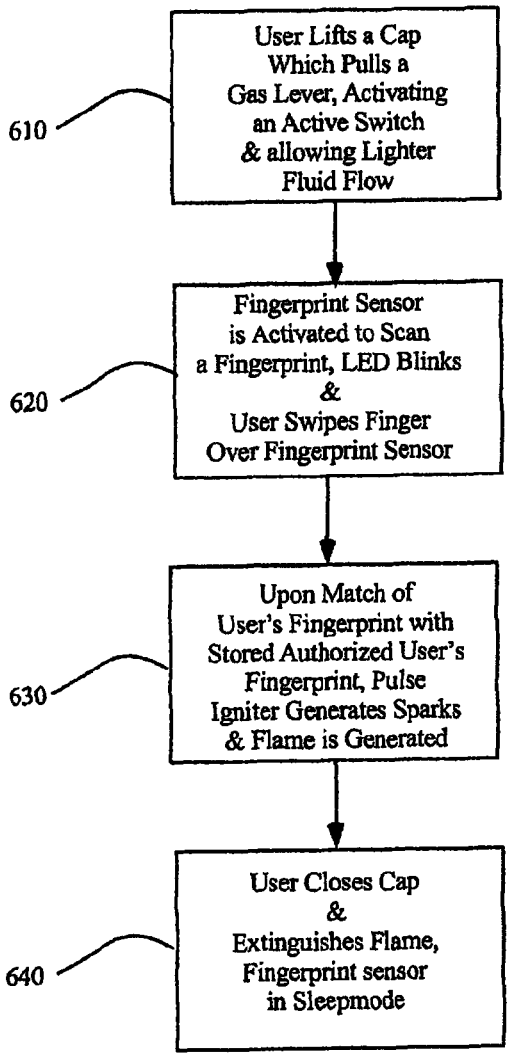
FIG. 6 is a flowchart showing the steps of igniting a flame for the portable biometric lighter, in accordance with the embodiment of FIG. 1.

Referring to FIG. 6, a flowchart illustrates the steps of activating, e.g., igniting a flame, by the portable biometric lighter device 100, in accordance with the embodiment of FIG. 1. The first step of igniting a flame 610 comprises a user opening a cap 110, whereby a gas lever 350 is actuated, thereby actuating an active switch 320 via contact pressure or electromagnetic force. The actuation of the gas lever 350 also simultaneously causes a lifting of a nozzle 340, which allows the lighter fluid 360 to be released from the lighter fluid valve 310.

The second step 620 of igniting a flame comprises the active switch 320, activating, via a control unit 210, the fingerprint sensor 140 to read or to scan a fingerprint and to repeatedly blink an LED 150 indicating to the user that the fingerprint sensor 140 is in "scan" or "read" mode. The third step 630 of igniting the flame comprises the control unit 210 determining that the scanned fingerprint matches an authorized user's fingerprint that is stored in memory. If the scanned fingerprint matches an authorized user's fingerprint that is stored in memory, the control unit 210 will activate a pulse igniter 370, e.g., a piezoelectric based circuit, thereby generating a plurality of high voltage sparks through the pole 330 to the nozzle 340. A flame is thereby generated via lighter fluid 360 flowing through the nozzle 340. However, if the scanned fingerprint does not match an authorized user's fingerprint that is stored in memory, the LED 150 will blink in a red color and then subsequently in a green color as the fingerprint sensor 140 continues to read or scan a fingerprint.

While the embodiment in FIG. 6 involves the control unit 210 activating a pulse igniter 370 upon a fingerprint match, alternative embodiments may also involve the control unit 210 deactivating, via a solenoid and at least one of the following elements: a push button (not shown), a cap lock (not shown), the cap lock being releasable, a gas valve lock (not shown), an electric gas valve (not shown), the electric gas valve being switchable to an "on" position. The fourth step 640 of igniting a flame comprises the user closing the cap 110, thereby extinguishing the flame and the control unit 210 deactivating the fingerprint sensor, e.g., sleep mode.

Figure 7:
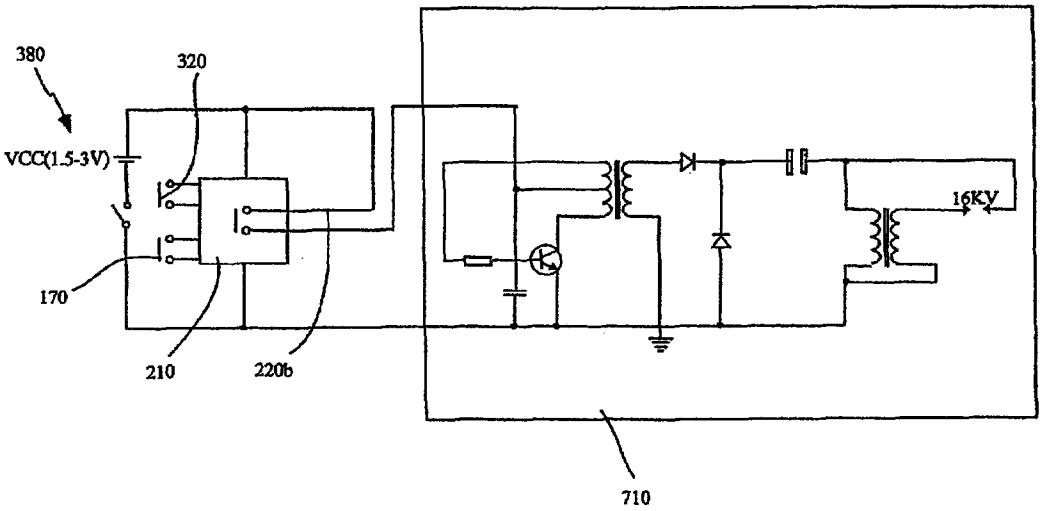
FIG. 7 is a circuit diagram of the portable biometric lighter, in accordance with the embodiment of FIG. 1, showing a control unit, a power source, a control line, a set switch, an exemplary pulse igniter circuit, and an active switch.

Referring to FIG. 7, a circuit diagram of the portable biometric lighter device 100 is shown, in accordance with the embodiment of FIG. 1. The portable biometric lighter device 100 comprises a control unit 210, a power source 380, a control line **220*b*, a set switch 170, an exemplary pulse igniter circuit 710, and an active switch 320. The power source 380 continuously provides power to the control unit 210**.

Figure 8:
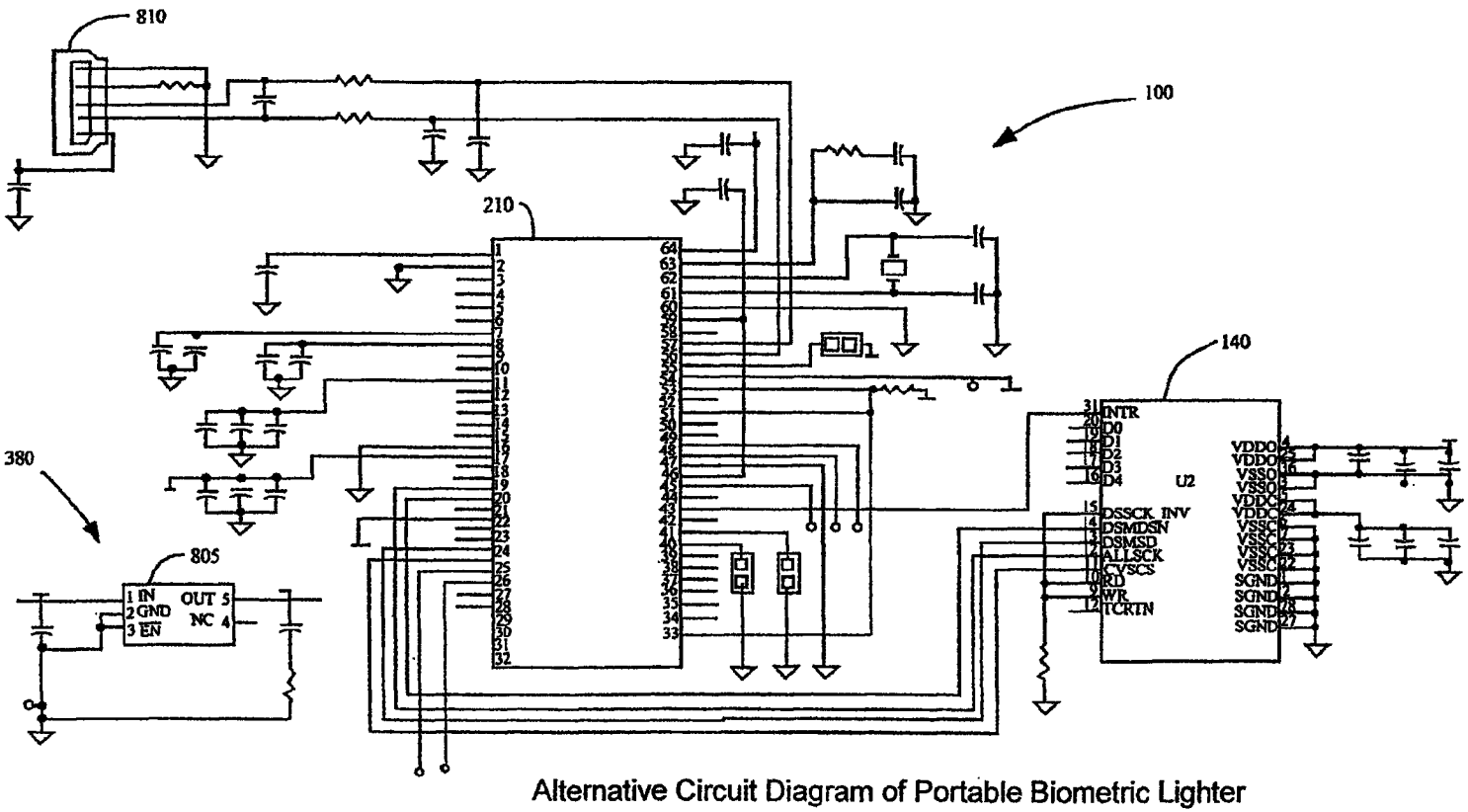
FIG. 8 is an alternative circuit diagram of the portable biometric lighter, in accordance with the embodiment of FIG. 1.

Referring to FIG. 8, an alternative circuit diagram of the portable biometric lighter device 100 is illustrated, in accordance with the embodiment of FIG. 1. In particular, device 100 is shown having control unit 210 coupled to fingerprint sensor 140. In the depicted embodiment, control unit 210 may be implemented using a microcontroller such as the ARM thumb-based microcontroller Model No. AT91SAM7S256, available from ARM, Inc., of Austin Tex. In addition, the fingerprint sensor 140 is shown implemented using the ATW210 fingerprint sensor available from Atrua Technologies, Inc., of Campbell Calif. FIG. 8 also shows USB port 810 coupled to leads 56 and 57 of control unit 210.

Power source 380 is shown providing power to voltage regulator 805. The voltage regulator is shown implemented using the TPS76933 voltage regulator provided by Texas Instruments of Dallas, Tex. It is understood that during operation of voltage regulator 805, a reference voltage of 1.7V or greater on input 3 will disable the internal circuitry of the voltage regulator, thus significantly reducing the supply current via output 5. On the other hand, a voltage of less than 0.9 V on input 3 will enable the voltage regulator and will enable operation of the controlled devices (e.g., control unit 210 and fingerprint sensor 140). Accordingly, in the embodiment of FIG. 8, the power source 380 does not provide power to the control unit 210 and the fingerprint sensor 140 until a user flips open the cap 110 that activates the gas lever 350 and the active switch 320 or the user depresses the set switch 170.

Control unit 210 is shown with leads 1-33 along the left side of the control unit, and leads 34-64 continuing along the opposing side. Table 1 setout below includes a pinout of the leads implemented by control unit 210.

TABLE 1

| | |
|---|---|
| 1 | ADVREF |
| 2 | GND |
| 3 | AD4 |
| 4 | AD5 |
| 5 | AD6 |
| 6 | AD7 |
| 7 | VDDIN |
| 8 | VDDOUT |
| 9 | PA17/PGMD5/AD0 |
| 10 | PA18/PGMD6/AD1 |
| 11 | PA21/PGMD9 |
| 12 | VDDCORE |
| 13 | PA19/PGMD7/AD2 |
| 14 | PA22/PGMD10 |
| 15 | PA23/PGMD11 |
| 16 | PA20/PGMD8/AD3 |
| 17 | GND |
| 18 | VDDIO |
| 19 | PA16/PGMD4 |
| 20 | PA15/PGMD3 |
| 21 | PA14/PGMD2 |
| 22 | PA13/PGMD1 |
| 23 | PA24/PGMD12 |
| 24 | VDDCORE |
| 25 | PA25/PGMD13 |
| 26 | PA26/PGMD14 |
| 27 | PA12/PGMD0 |
| 28 | PA11/PGMM3 |
| 29 | PA10/PGMM2 |
| 30 | PA9/PGMM1 |
| 31 | PA8/PGMM0 |
| 32 | PA7/PGMNVALID |
| 33 | TDI |
| 34 | PA6/PGMNOE |
| 35 | PA5/PGMRDY |
| 36 | PA4/PGMNCMD |
| 37 | PA27/PGMD15 |
| 38 | PA28 |
| 39 | NRST |
| 40 | TST |
| 41 | PA29 |
| 42 | PA30 |
| 43 | PA3 |
| 44 | PA2/PGMEN2 |
| 45 | VDDIO |
| 46 | GND |
| 47 | PA1/PGMEN1 |
| 48 | PA0/PGMEN0 |
| 49 | TDO |
| 50 | JTAGSEL |
| 51 | TMS |
| 52 | PA31 |
| 53 | TCK |
| 54 | VDDCORE |
| 55 | ERASE |
| 56 | DDM |
| 57 | DDP |
| 58 | VDDIO |
| 59 | VDDFLASH |
| 60 | GND |
| 61 | XOUT |
| 62 | XIN/PGMCK |

TABLE 1-continued

| | |
|---|---|
| 63 | PLLRC |
| 64 | VDDPLL |

Figure 9:
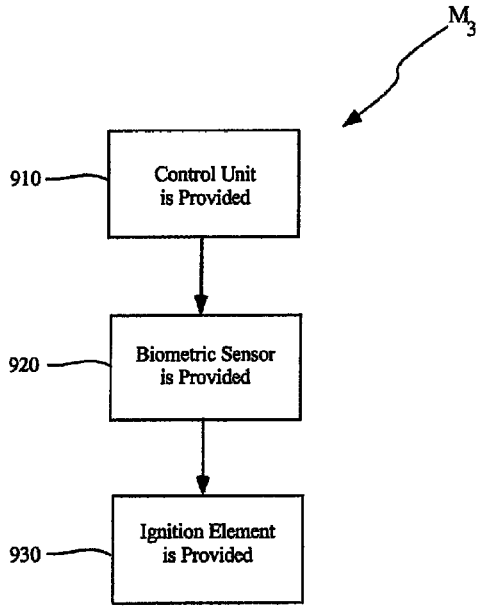
FIG. 9 is a flowchart showing a method of fabricating a portable biometric lighter device.

Referring to FIG. 9, a method $M_3$ of fabricating a portable biometric lighter device 100 is shown, the method $M_3$ comprising the steps of: providing a control unit 210, as indicated by block 910; providing a biometric sensor, e.g., a fingerprint sensor 140, wherein the biometric sensor providing step comprises configuring the biometric sensor to scan biometric data of a user and operably coupling the biometric sensor to the control unit 210, as indicated by block 920; and providing an ignition element, wherein the ignition element providing step comprises rendering the ignition element activable by the control unit 210 upon a match of the scanned biometric data of the user and biometric data of an authorized user that is stored in a memory device, as indicated by block 930, wherein the biometric sensor providing step comprises providing a fingerprint sensor 140, wherein the biometric sensor providing step comprises providing biometric data, and wherein the biometric data providing step comprises providing a fingerprint, wherein the biometric data of the authorized user providing step comprises providing a fingerprint, and wherein the ignition element providing step comprises providing a piezoelectric pulse igniter.

Information as herein shown and described in detail is fully capable of attaining the above-described object of the invention, the presently preferred embodiment of the invention, and is, thus, representative of the subject matter which is broadly contemplated by the present invention. The scope of the present invention fully encompasses other embodiments which may become obvious to those skilled in the art, and is to be limited, accordingly, by nothing other than the appended claims, wherein reference to an element in the singular is not intended to mean "one and only one" unless explicitly so stated, but rather "one or more." All structural and functional equivalents to the elements of the above-described preferred embodiment and additional embodiments that are known to those of ordinary skill in the art are hereby expressly incorporated by reference and are intended to be encompassed by the present claims.

Moreover, no requirement exists for a device or method to address each and every problem sought to be resolved by the present invention, for such to be encompassed by the present claims. Furthermore, no element, component, or method step in the present disclosure is intended to be dedicated to the public regardless of whether the element, component, or method step is explicitly recited in the claims. However, that various changes and modifications in form, material, and fabrication material detail may be made, without departing from the spirit and scope of the inventions as set forth in the appended claims, should be readily apparent to those of ordinary skill in the art. No claim herein is to be construed under the provisions of 35 U.S.C. §112, sixth paragraph, unless the element is expressly recited using the phrase "means for."

INDUSTRIAL APPLICABILITY

The present invention industrially applies to lighters and igniters. More specifically, the present invention industrially applies to portable biometric lighter devices. Even more specifically, the present invention industrially applies to portable biometric lighter devices using biometric data to prevent unauthorized usage, e.g., by a minor child.

What is claimed:

1. A portable biometric lighter device, comprising:

a control unit operably coupled to an igniter, the igniter coupled to a flammable power source wherein the flammable power source is ignited upon operation of the igniter;

a memory device storing biometric data including at least one fingerprint of at least one authorized user;

a body having a cover and including a biometric sensor, the cover configured to move between a closed position and an open position and to activate the biometric sensor and a gas lever when the movable cover is moved toward the open position, the biometric sensor being operably connected to the control unit and configured to scan a fingerprint of a user;

a light source configured to provide status of the biometric sensor and to indicate, to the user, that the biometric sensor is ready to scan biometric data of the user; and an igniter operably coupled to the control unit and configured to ignite the flammable power source to produce a flame in response to being activated by the control unit upon a determination by the control unit that the fingerprint of the user scanned by the biometric sensor matches the biometric data of the authorized user stored in a memory device.

2. The device of claim 1, wherein the biometric sensor comprises a fingerprint sensor.

3. The device of claim 1, wherein the biometric data comprises a fingerprint.

4. The device of claim 1, wherein the igniter is a piezoelectric pulse igniter.

5. The device of claim 1, further comprising an active switch operably coupled to a biometric sensor, and configured to activate, via the control unit, the biometric sensor, wherein the gas lever is configured to activate the active switch when the gas lever is actuated.

6. A method for lighting a portable biometric lighter device, the method comprising:

providing a control unit operably coupled to an igniter, the igniter coupled to a flammable power source wherein the flammable power source is ignited upon operation of the igniter;

providing a memory device storing biometric data including at least one fingerprint of at least one authorized user;

providing a body having a cover and including a biometric sensor, the cover configured to move between a closed position and an open position and to activate the biometric sensor and a gas lever when the movable cover is moved toward the open position, the biometric sensor being operably connected to the control unit and configured to scan a fingerprint of a user;

providing a light source configured to provide status of the biometric sensor and to indicate, to the user, that the biometric sensor is ready to scan biometric data of the user; and providing an igniter operably coupled to the control unit and configured to ignite the flammable power source to produce a flame in response to being activated by the control unit;

scanning biometric data of the user via the biometric sensor activated after the cover is moved to the open position;

determining, via the control unit that the fingerprint of the user scanned by the biometric sensor matches the biometric data of the authorized user stored in a memory device; and activating, via the control unit, the igniter in order to ignite the flammable power source via the activated igniter.

7. The method of claim 6, wherein the biometric sensor comprises a fingerprint sensor.

8. The method of claim 6, wherein the biometric data comprises a fingerprint.

9. The method of claim 6, wherein the igniter is a piezoelectric pulse igniter.

10. The method of claim 6, further comprising:

providing an active switch operably coupled to a biometric sensor and configured to activate, via the control unit, the biometric sensor;

activating, via the actuated gas lever, the active switch.

* * * * *